US007898130B2

(12) United States Patent
Tian et al.

(10) Patent No.: US 7,898,130 B2
(45) Date of Patent: Mar. 1, 2011

(54) CONTROL SERVO

(76) Inventors: Yu Tian, Shanghai (CN); Wenyan Jiang, Shanghai (CN)

( * ) Notice: Subject to any disclaimer, the term of this patent is extended or adjusted under 35 U.S.C. 154(b) by 242 days.

(21) Appl. No.: 12/087,242

(22) PCT Filed: Apr. 17, 2007

(86) PCT No.: PCT/CN2007/001249

§ 371 (c)(1),
(2), (4) Date: Dec. 30, 2008

(87) PCT Pub. No.: WO2008/124970

PCT Pub. Date: Oct. 23, 2008

(65) Prior Publication Data

US 2010/0066215 A1 Mar. 18, 2010

(51) Int. Cl.
*H02K 11/00* (2006.01)

(52) U.S. Cl. ..... 310/71; 310/68 R

(58) Field of Classification Search ..... 310/71, 310/68 R, 83, 75 R, 67 R, 12.14
See application file for complete search history.

(56) References Cited

U.S. PATENT DOCUMENTS

| | | | | |
|---|---|---|---|---|
| 3,364,417 | A * | 1/1968 | Norton et al. | 323/352 |
| 4,095,784 | A * | 6/1978 | Kennedy et al. | 472/9 |
| 2003/0082991 | A1 * | 5/2003 | Tian et al. | 446/454 |
| 2005/0109145 | A1 * | 5/2005 | Levin et al. | 74/473.12 |
| 2006/0283279 | A1 * | 12/2006 | Levin et al. | 74/471 XY |
| 2007/0259595 | A1 * | 11/2007 | Amireh et al. | 446/57 |

* cited by examiner

*Primary Examiner* — Thanh Lam

(74) *Attorney, Agent, or Firm* — Raymond Y. Chan; David and Raymond Patent Firm

(57) ABSTRACT

A control servo includes a supporting frame, a motor, a driving shaft and a control slider. The supporting frame comprises a mount and a slider housing, wherein the motor is supported in the mount of the supporting frame. A driving gear is provided at an output end of the motor. The driving shaft is positioned longitudinally through the slider housing. A driven gear is provided at one end of the driving shaft to mesh with the driving gear. The driving shaft penetrates through the control slider while an upper portion of the control slider extends out of the slider housing. An electric brush is provided underneath the control slider. The control servo eliminates the use a potentiometer as installed in a traditional servo and the reduction gearbox so that the structure is simpler and lighter; thus it plays an important part in the miniaturisation of model aircraft.

20 Claims, 5 Drawing Sheets

CONTROL SERVO

BACKGROUND OF THE PRESENT INVENTION

1. Field of Invention

The present invention relates to a control servo or control device, and more particularly to a control servo having a simple structure, relatively light weight and high integration for controlling a remote-controlled model aircraft.

2. Description of Related Arts

A conventional model aircraft is remotely controlled to take-off, land and turn via the movement of the aerofoil surfaces by means of the rudder or other steering device. For larger aircraft, weight is not the main issue as there is sufficient power for a wide choice of servos. However, with the demand for entertainment, the development of small scale and micro scale model aircraft is growing rapidly. The small scale and micro aircraft has a critical requirement in its weight. The conventional model aircraft servos are complicated and required to include a complex gear reduction system so it is hard to reduce the overall weight and size of the servo and in turn the weight of the aircraft. In other words, the structure of the servo restricts the development of the small-scale model aircraft from further miniaturization.

SUMMARY OF THE PRESENT INVENTION

An object of the present invention is to provide a control servo which has simple structural configuration and light weight.

Accordingly, in order to accomplish the above objective, the present invention provides a control servo, which comprises a supporting frame, a motor, a driving shaft and a control slider. The supporting frame comprises a mount and a slider cavity, wherein the motor is supported in the mount of the supporting frame. In order to transmitting power between the motor and the driving shaft , a driving gear provided at an output end of the motor and a driven gear provided at one end of the driving shaft. The driving shaft is positioned longitudinally through the slider cavity. The driven gear is to mesh with the driving gear such that when the driving gear is driven to rotate by the motor, the driving shaft is rotated by the driven gear. The driving shaft penetrates through the control slider while an upper portion of the control slider extends out of the slider cavity in such a manner that the control slider moves along the slider cavity when the driving shaft is rotated. An electric brush is provided underneath the control slider.

According to the present invention, the control circuit board of the control servo has drive circuit provided thereon, wherein the supporting frame has at least an affixing hole for affixing the supporting frame to the control circuit board via an affixing means.

The control circuit board has an elongated carbon film and an elongated silver film spaced apart printed thereon, wherein the electric brush is in electrical contact with the carbon and silver films when the supporting frame is mounted on the control circuit.

The control servo further comprises a retention bushing attached at the opposite end of the driving shaft.

The control slider has a longitudinal sliding slot where the driving shaft passes therethrough, so that the outer threaded portion of the threaded driving shaft is engaged with the inner threaded portion of the control slider so as to make the control slider to slide when the threaded shaft is rotated.

A plurality of coupling holes is provided at the upper portion of the control slider for coupling with moving parts of the aerofoil.

Accordingly, the difference between the present invention and the conventional art is that the present invention does not require any traditional potentiometer and eliminates the complex gear reduction box and the traditional circuit board. The present invention also simplifies the structural configuration by integrating the carbon film of the potentiometer with the circuit board. Therefore, the present invention provides a control servo having the features of simple structural configuration, relatively light weight, and high integration. Most importantly, the weight of the control servo can be significantly reduced so as to be incorporated within smaller and micro scale aircraft so as to advance the development of such model aircraft.

These and other objectives, features, and advantages of the present invention will become apparent from the following detailed description, the accompanying drawings, and the appended claims.

DETAILED DESCRIPTION OF THE PREFERRED EMBODIMENT

Figure 1:
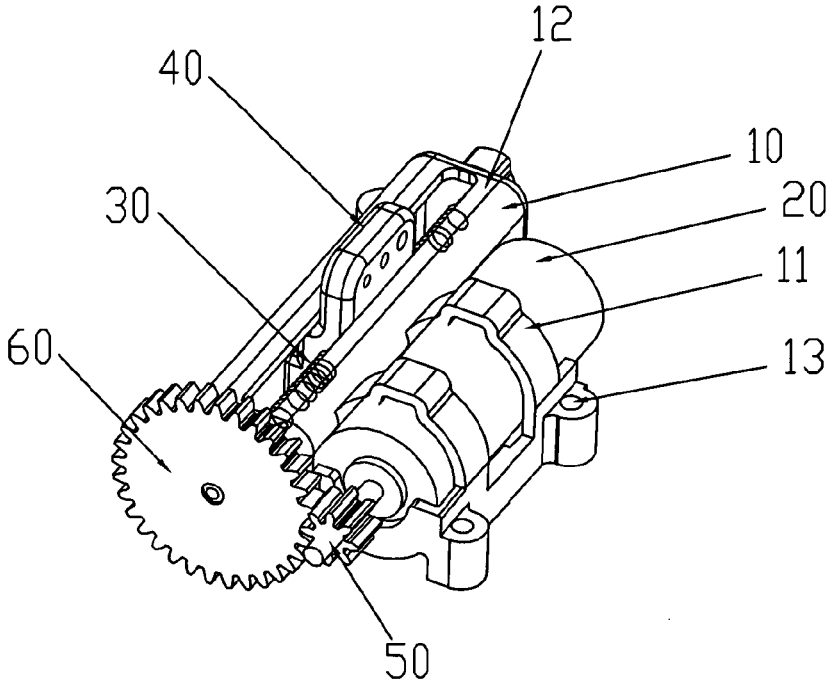
FIG. 1 is a perspective view of a control servo according to a preferred embodiment of the present invention.
Figure 2:
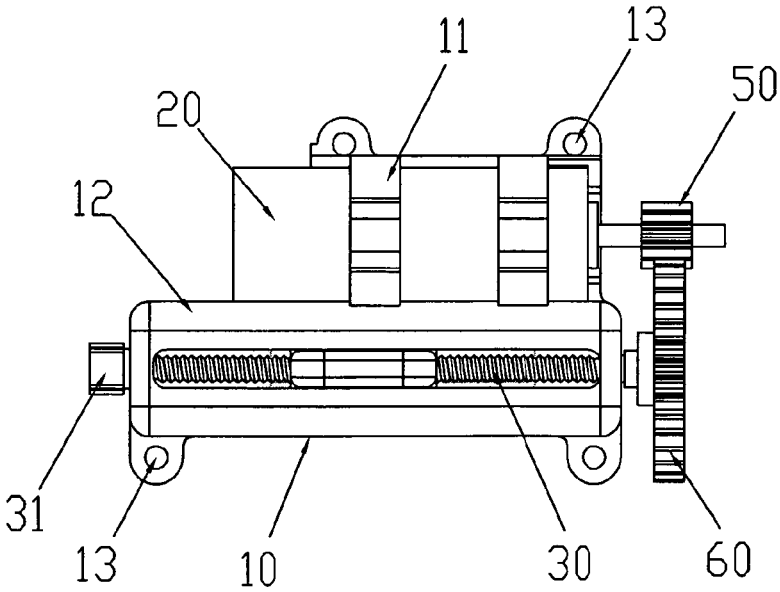
FIG. 2 is a top view of the control servo according to the above preferred embodiment of the present invention.
Figure 3:
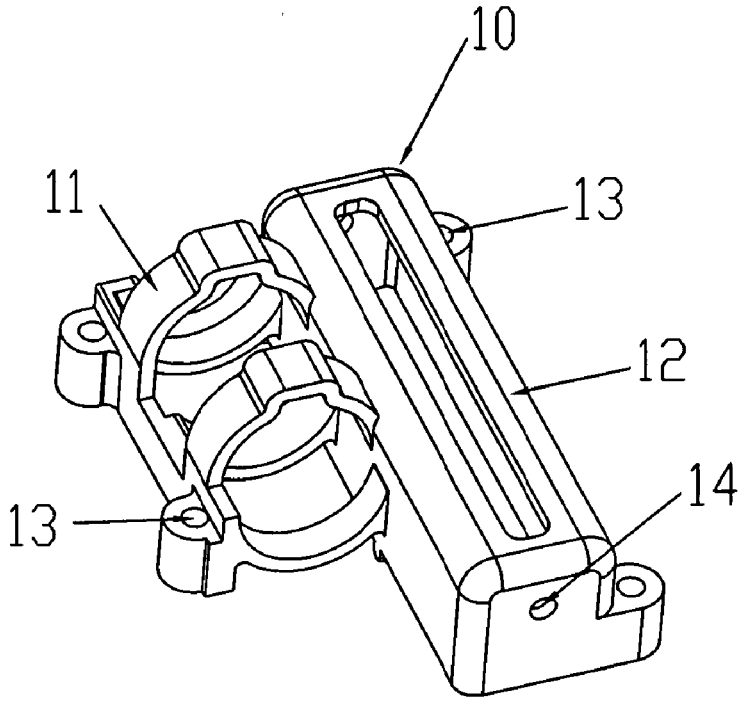
FIG. 3 is a perspective view of the supporting frame of the control servo according to the above preferred embodiment of the present invention.

Referring to FIGS. 1 and 2 of the drawings, a control servo for a model aircraft according a preferred embodiment of the present invention is illustrated, wherein the control servo comprises a supporting frame 10, a motor 20 which is embodied as an electric motor, a driving shaft 30 which is an elongated shaft having an outer threaded portion, and a control slider 40. Further referencing FIG. 3, the supporting frame 10 comprises a mount 11 and a slider cavity 12, wherein the mount 11 has a round hoop structure so that the motor 20 is supported by the supporting frame 10 via the hoop structure of the mount 11. Accordingly, the mount 11 and the slider cavity 12 are positioned side-by-side such that the mount 11 is parallel to the slider cavity 12 to form a one-piece integral structure of the supporting frame 10. The slider cavity 12 has two side-openings 14 formed at both ends of the supporting frame 10 respectively, wherein the threaded driving shaft 30 is longitudinally extended through the slider cavity 12 at a position so that two ends of the threaded driving shaft 30 are extended out of the slider cavity 12 through the side-openings 14. The control slider 40 has a bottom portion slidably coupled with the threaded driving shaft 30 within the slider cavity 12.

Figure 4:
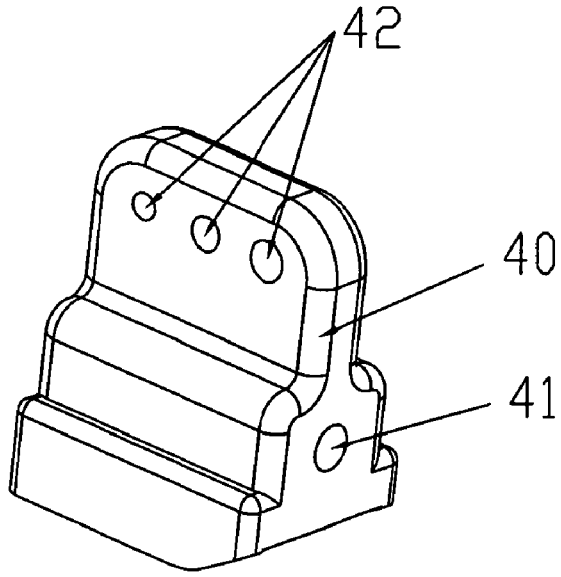
FIG. 4 is a perspective view of the control slider of the control servo according to the above preferred embodiment of the present invention.

As shown in FIG. 4, the control slider 40 has a longitudinal sliding slot 41 having an inner threaded portion provided along the surrounding wall thereof, wherein the threaded driving shaft 30 is extended through the sliding slot 41 at a position that the outer threaded portion of the threaded driving shaft 30 is engaged with the inner threaded portion of the control slider 40 so as to drive the control slider 40 to slide when the threaded driving shaft 30 is rotated.

The upper portion of the control slider 40 is extended out of the slider cavity 12. A plurality of coupling holes 42, in which three coupling holes 42 are shown in FIG. 4, is spacedly provided at the upper portion of the control slider 40 for coupling with the moving parts of the aerofoil, such as rudder or steering device, through one or more control cables (not shown in Figures). Therefore, when the control slider 40 is driven to slide along the slider cavity 12, the moving parts of the aerofoil are moved correspondingly to steer the model aircraft. It is worth mentioning that the number of coupling holes 42 can be selectively added or reduced and the diameter of each of the coupling holes 42 can be selectively modified according to the actual operation of the aerofoil.

Referring to FIGS. 1 and 2, a driving gear 50 and a driven gear 60 is provided for transmitting power. An output end of the motor 20 is coupled with the driving gear 50 so that the driving gear 50 is driven to rotate by the motor 20. One end of the threaded driving shaft 30 is coupled with the driven gear 60 which is mesh with the driving gear 50 such that when the driving gear 50 is rotated, the driving shaft 30 is driven to be rotated through the driven gear 60. A gear diameter of the driving gear 50 is smaller than that of the driven gear 60 so as to reduce the speed from the motor 20 to the driving shaft 30. In order to prevent the driving shaft 30 from being disengaged from the supporting frame 10 during the rotational operation, a retention bushing 31 is coupled at the other end of the driving shaft 30. In other words, the two ends of the threaded shaft 30 are coupled with the driven gear 60 and the retention bushing 31 respectively such that the driving draft 30 is securely retained at the slider cavity 12 of the supporting frame 10.

Figure 5:
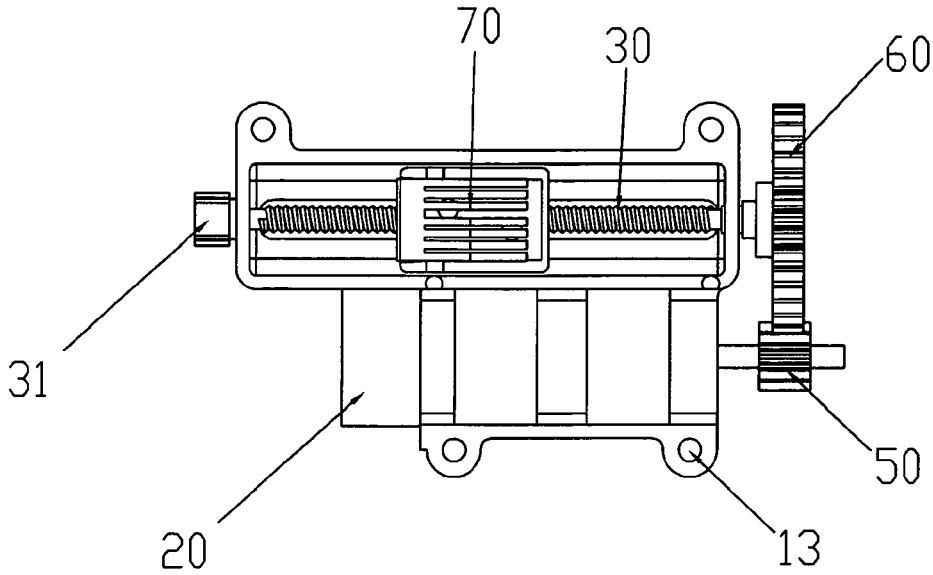
FIG. 5 is a bottom view of the control servo according to the above preferred embodiment of the present invention.
Figure 6:
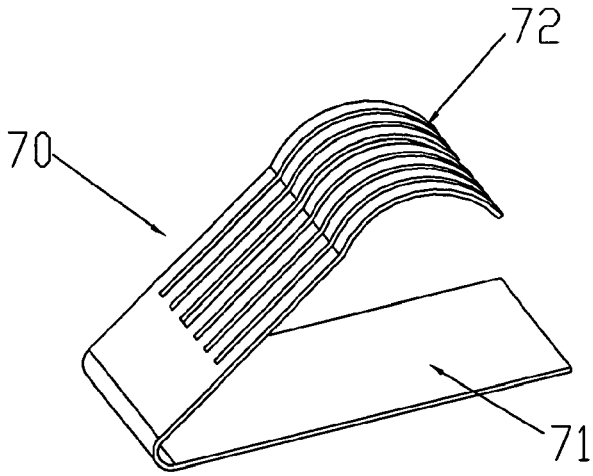
FIG. 6 is a perspective view of the electric brush of the control servo according to the above preferred embodiment of the present invention.

As shown in FIG. 5, the control servo of the present invention further comprises an electric brush 70 which is provided at the bottom side of the control slider 40. As shown in FIG. 6, the electric brush 70 comprises a contacting side 71 and a brushing side 72, wherein the brushing side 72 is inclinedly extended from the contacting side 71 at an acute angle. The electric brush 70 is made of a thin copper piece which is flexible and electrically conductive. The contacting side 71 of the electric brush 70 is coupled at the bottom side of the control slider 40 while the brushing side 72 is downwardly and inclinedly extended from the bottom side of the control slider 40.

Figure 7:
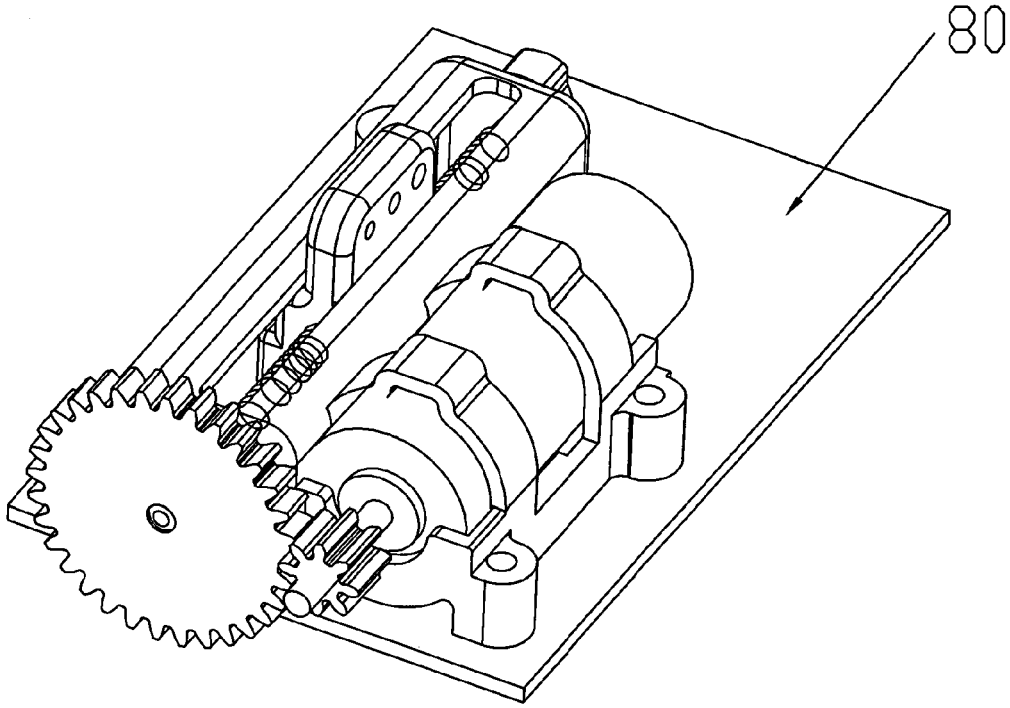
FIG. 7 is a perspective view of the control servo according to the above preferred embodiment of the present invention, illustrating the supporting frame being mounted on the control circuit board.
Figure 8:
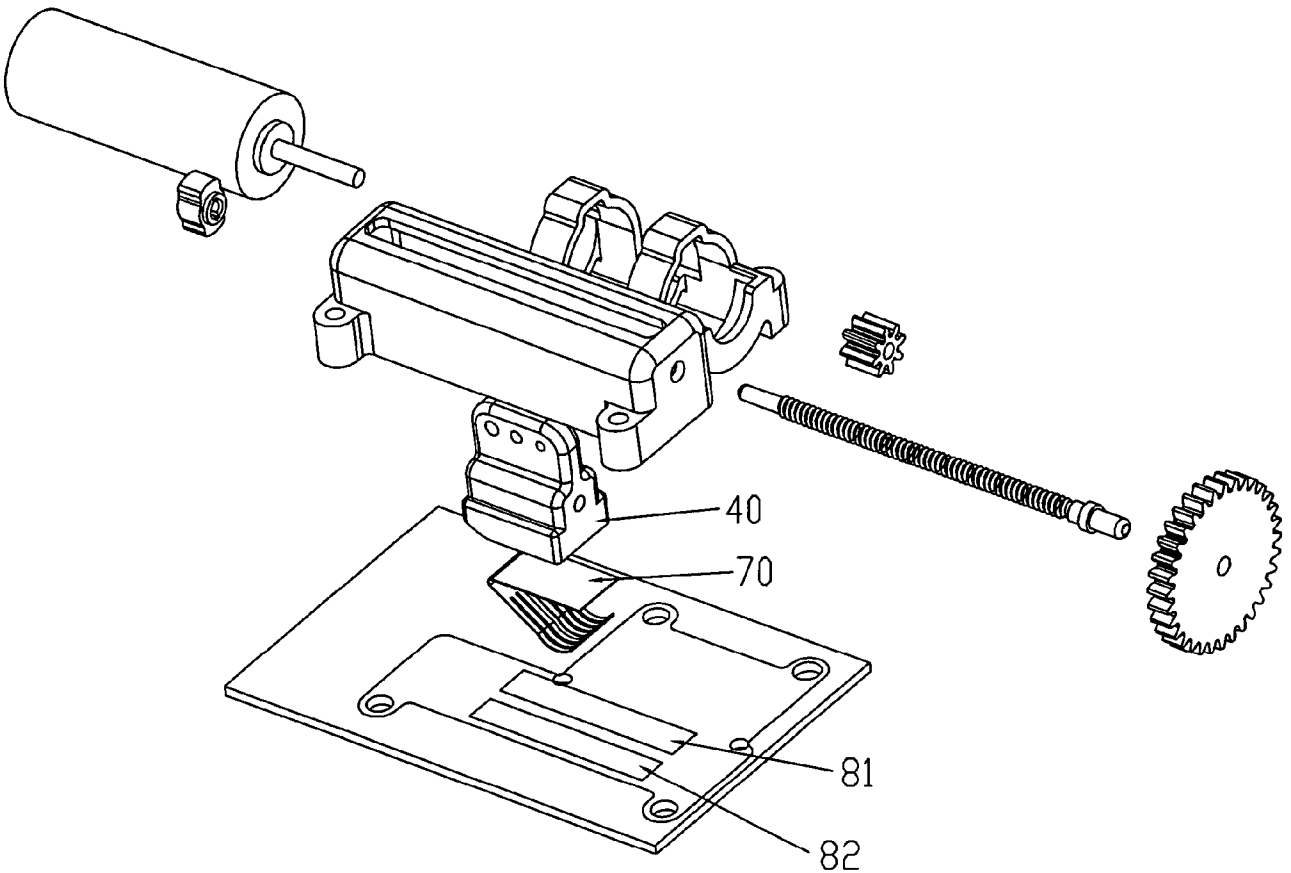
FIG. 8 is an exploded perspective view of the control servo according to the above preferred embodiment of the present invention.

As shown in FIGS. 1 and 2, the supporting frame 10 has at least an affixing hole 13. Preferably two or more affixing holes 13 are spacedly provided at the peripheral side of the supporting frame 10. As shown in FIGS. 7 and 8, the supporting frame 10 is mounted at a control circuit board 80 through the affixing holes 13 by the affixing means such as screws. Accordingly, the control circuit board 80 has a drive circuit printed thereon. In order to retain the position of the electric brush 70, the control circuit board 80 has two conductive films spacedly printed on the control circuit board 80 at the area for positioning the supporting frame 10. wherein the two conductive films can be an elongated carbon film 81 and an elongated silver film 82 respectively. In other words, when the supporting frame 10 is mounted at the control circuit board 80, the brushing side 72 of the electric brush 70 is electrically contacted with the carbon film 81 and the silver film 82, so as to provide a brush structure similar to the sliding potentiometer.

According to the present invention as disclosed above, the control servo of the present invention does not require any traditional potentiometer and eliminates the complex gear reduction box and the traditional circuit board. The present invention also simplifies the structural configuration by integrating the carbon film of the potentiometer with the circuit board, so that the control servo of the present invention provides the features of simple structural configuration, relatively light weight, and high integration. Most importantly, the weight of the control servo can be significantly reduced so as to be incorporated within smaller and micro scale aircraft to advance the development of such model aircraft.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A control servo for controlling one or more aerofoil surfaces of a remote-controlled model aircraft, comprising:

a supporting frame;

a motor mounted on said supporting frame;

a control slider slidably disposed in said supporting frame adjacent to said motor;

a driving shaft coupled with said control slider in such a manner that said control slider is driven by said driving shaft to slide along said driving shaft during a rotation of said driving shaft for controlling the aerofoil surfaces of the model aircraft, wherein said driving shaft is driven to rotate by power output of said motor; and an electric brush provided underneath said control slider.

2. The control servo, as recited in claim 1, further comprising a control circuit board, wherein said supporting frame is affixed on said control circuit board and in electrical contact with said electric brush.

3. The control servo, as recited in claim 2, wherein said supporting frame comprises a mount supporting said motor and a slider cavity, wherein said driving shaft is positioned longitudinally through said slider cavity.

4. The control servo, as recited in claim 3, further comprising a driving gear and a driven gear, wherein said driving gear is coupled at an output end of said motor and driven to rotate by said motor, wherein said driven gear is coupled at one end of said driving shaft and mesh with said driving gear such that said driving gear is rotated, said driving shaft is driven to be rotated through said driven gear.

5. The control servo, as recited in claim 4, wherein said driving shaft is an elongated threaded shaft and said control slider has a bottom portion slidably coupled with said driving shaft and an upper portion extended out of said slider cavity, wherein said control slider is driven to slide at said slider cavity when said driving shaft is rotated.

6. The control servo, as recited in claim 3, wherein said control circuit board has two conductive films spacedly printed thereon, wherein said electric brush is electrically contacted with said two conductive films when said supporting frame is mounted on said control circuit board.

7. The control servo, as recited in claim 5, wherein said control circuit board has two conductive films spacedly printed thereon, wherein said electric brush is electrically contacted with said two conductive films when said supporting frame is mounted on said control circuit board.

8. The control servo, as recited in claim 6, wherein said two conductive films are a carbon film and a silver film respectively.

9. The control servo, as recited in claim 7, wherein said two conductive films are a carbon film and a silver film respectively.

10. The control servo, as recited in claim 3, wherein said control slider has a longitudinal sliding slot and an inner threaded portion provided at an surrounding wall of said sliding slot, wherein said driving shaft is extended through said sliding slot at a position that said outer threaded portion of said driving shaft is engaged with said inner threaded portion of said control slider to drive said control slider to slide when said threaded shaft is rotated.

11. The control servo, as recited in claim 6, wherein said control slider has a longitudinal sliding slot and an inner threaded portion provided at an surrounding wall of said sliding slot, wherein said driving shaft is extended through said sliding slot at a position that said outer threaded portion of said driving shaft is engaged with said inner threaded portion of said control slider to drive said control slider to slide when said threaded shaft is rotated.

12. The control servo, as recited in claim 9, wherein said control slider has a longitudinal sliding slot and an inner threaded portion provided at an surrounding wall of said sliding slot, wherein said driving shaft is extended through said sliding slot at a position that said outer threaded portion of said driving shaft is engaged with said inner threaded portion of said control slider to drive said control slider to slide when said threaded shaft is rotated.

13. The control servo, as recited in claim 1, wherein one or more coupling holes are spacedly provided at said upper portion of said control slider.

14. The control servo, as recited in claim 5, wherein one or more coupling holes are spacedly provided at said upper portion of said control slider.

15. The control servo, as recited in claim 7, wherein one or more coupling holes are spacedly provided at said upper portion of said control slider.

16. The control servo, as recited in claim 12, wherein one or more coupling holes are spacedly provided at said upper portion of said control slider.

17. The control servo, as recited in claim 4, wherein a retention bushing is coupled with the other end of said driving shaft.

18. The control servo, as recited in claim 5, wherein a retention bushing is coupled with the other end of said driving shaft.

19. The control servo, as recited in claim 7, wherein a retention bushing is coupled with the other end of said driving shaft.

20. The control servo, as recited in claim 10, wherein a retention bushing is coupled with the other end of said driving shaft.

* * * * *